US005871055A

United States Patent [19]

Sundholm

[11] Patent Number: 5,871,055

[45] Date of Patent: Feb. 16, 1999

[54] INSTALLATION FOR FIRE FIGHTING AND SPRINKLER

[76] Inventor: Göran Sundholm, Ilmari Kiannon kuja 3, FIN-04310 Tuusula, Finland

[21] Appl. No.: 718,371

[22] PCT Filed: May 16, 1995

[86] PCT No.: PCT/FI95/00258

§ 371 Date: Sep. 25, 1996

§ 102(e) Date: Sep. 25, 1996

[87] PCT Pub. No.: WO95/31254

PCT Pub. Date: Nov. 23, 1995

[30] Foreign Application Priority Data

May 17, 1994 [FI] Finland ..... 942299

[51] Int. Cl.[6] ..... A62C 37/50

[52] U.S. Cl. ..... 169/16; 169/37

[58] Field of Search ..... 169/16, 37, 38, 169/39, 40, 41

[56] References Cited

U.S. PATENT DOCUMENTS

| | | | |
|---|---|---|---|
| 3,884,304 | 5/1975 | Messerschmidt et al. | 169/16 |
| 4,175,677 | 11/1979 | Poeschl et al. | 222/5 |
| 4,359,097 | 11/1982 | Claussen | 169/16 |
| 4,597,451 | 7/1986 | Moore et al. | 169/61 |
| 5,531,275 | 7/1996 | Sundholm | 169/16 |

FOREIGN PATENT DOCUMENTS

| | | | |
|---|---|---|---|
| 572752 | 2/1976 | Switzerland | 169/16 |
| 93010860 A1 | 6/1993 | WIPO | 169/16 |

*Primary Examiner*—Gary C. Hoge
*Attorney, Agent, or Firm*—Ladas & Parry

[57] ABSTRACT

The invention relates to an installation for fire fighting, using a number of automatically released sprinklers. The invention also relates to a sprinkler to be used in the installation. With the aim of conserving extinguishing liquid, reducing the size of the drive unit of the installation intended for the procedure and providing an active installation that is released directly by a sprinkler, the installation comprises a number of electric positive and negative wires, which have been arranged to a scanning device comprising breakers (+A–+E, –13, ––19) for each positive and negative wire, whereby said wires form an electric net where positive and negative wires are electrically connected via sprinklers respectively comprising individual breakers (K), whereby each sprinkler is arranged to open its breaker (K) upon the release the sprinkler in question and to thus interrupt the connection between the respective positive and negative wire, whereby the scanning device, upon establishing the interrupted connection and the position of the released sprinkler, is arranged to release according to a plan the sprinklers adjacent to said position by closing according to said plan the breakers (+A–+E, –13, ––19) of the scanning device.

2 Claims, 5 Drawing Sheets

STAGE 1

C15 IS INTERRUPTED
SCANNING STOPPED
INDICATION
START OF PUMPS

STAGE 2

ACTIVATE THE WIRES
14, 15, 16, B, C, D

HEATING SWITCHED ON

HEATING RESISTOR AROUND THE RELEASE BULB FOR ELECTRIC ACTIVATION (OPEN CIRCUIT IF BULB IS BROKEN)

UNBROKEN BULB

RELEASED BULB

STAGE 3

ACTIVATE THE WIRES
A AND E

INSTALLATION FOR FIRE FIGHTING AND SPRINKLER

The present invention relates to an installation for fire fighting, comprising a number of circuits with sprinklers, whereby each circuit is arranged to automatically be separately switched on in the event of a fire after release of a sprinkler in the circuit at the site of the fire. The invention also relates to a sprinkler comprising a housing and an inlet at the side of the housing to a central channel with a spindle in a sliding or almost sliding contact with the channel wall, which sprinkler is intended to be employed in said installation for fire fighting.

In previous known installations of this kind, e.g. an installation monitoring a vehicle deck on a car ferry, the monitored area in question has usually been divided into a number of circuits or sections that can be separately activated and that each can be relatively extensive. In modern car ferries having a width of, for instance, 40 meters, a section has normally extended across the entire width of the ship and about 20 meters along the length of the ship. Since a fire can very well break out at or near the joint between two sections, the possibility to simultaneously activate two sections has been considered necessary. This results first of all in a considerable waste of extinguishing liquid and also requires extremely powerful units for the delivery of the extinguishing liquid. The complete installation becomes unproportionately expensive.

German Offenlegungsschrift 2,548,850 discloses a fire fighting equipment comprising several sprinklers, the equipment being arranged—in order to provide optimum fire fighting with a relatively small amount of extinguishing medium—to release only part of all the sprinklers of the apparatus. The circuit, or those of the sprinklers, that is/are released is/are located in the immediate vicinity of the fire detector producing the signal. One problem of this known fire fighting equipment is that conventional fire detectors that are separate from the sprinklers are used. The fire detector may produce a false signal, as a result of which the wrong fire fighting circuit is switched on. A false signal may occur when the fire detector reacts to smoke that is drifting from a distant site of fire as a result of strong air currents. As a result, the fire detector causes such valves to open that convey extinguishing liquid to a fire fighting circuit that is not located near the fire. This problem is further aggravated by the fact that the fire detectors are typically relatively few in relation to the number of sprinklers. Another problem of this known fire fighting equipment is its complicated construction.

A fire fighting system which is arranged to control a number of fire fighting functions that are arranged in the same fire fighting line, such as the closure of fire-proof doors and the connecting of extinguishing devices, is known from German Offenlegungsschrift 2,533,354. In this system, separate fire detectors are also employed, which involves an uncertainty factor as explained above.

The object of the present invention is to provide a new fire fighting system which solves the above problems.

To achieve this object, the installation is characterized in that it comprises a number of electric positive and negatives wires, which have been arranged to a scanning device comprising breakers (+A–+E, –13, ––19) for each positive and negative wire, whereby said wires form an electric net where positive and negative wires are electrically connected via sprinklers respectively comprising individual breakers K, whereby each sprinkler is arranged to open its breaker K upon the release of the sprinkler in question and to thus interrupt the connection between the respective positive and negative wire, whereby the scanning device, upon establishing the interrupted connection and the position of the released sprinkler, is arranged to release according to a plan the sprinklers adjacent to said position by closing according to said plan the breakers (+A–+E, –13, ––19) of the scanning device. Preferably, the scanning device is arranged to release the desired number of adjacent sprinklers via the same electric wires that are used for the scanning, by conducting an electric current through a heating coil placed around a heat-sensitive release bulb of the respective sprinklers in order to heat the release bulb. The sprinklers of the system comprise a heat-sensitive release bulb which suitably can be a conventional vial.

The sprinkler according to the invention is characterized in that the spindle is arranged in said contact on both sides of the inlet for at least partial balancing of the fluid pressure of the inlet, whereby the spindle comprises an electricity conducting rod for electrically connecting a positive pole of the sprinkler to a negative pole of the sprinkler, which rod is arranged to interrupt the electric connection between the positive pole and the negative pole when the spindle is moving due to the sprinkler changing from the standby state to the released state. Preferably, the spindle is arranged, with a helical spring, in the central channel and the rod is arranged to be displaced with the movement of the spindle. As a result of the balancing of the fluid pressure, the spindle does not exert a great force against the release bulb, which could easily destroy the latter. The balancing of the fluid pressure can be complete, whereby the fluid pressure does not strive to press the spindle against the release bulb, or partial, whereby only a less powerful force which does not break the release bulb is applied against the latter.

The concept of the invention is in principal that at least a part, preferably all, of the sprinklers of the installation, which sprinklers comprise individual breakers reacting on fire, are continuously, repeatedly, and individually scanned in order to determine the position of a sprinkler that has been released as a result of a fire and that a predetermined number of sprinklers or spray heads in the surrounding are then released in one or several steps. Thus, the actual sprinkler actively releases the other sprinklers in the immediate vicinity of the fire. The scanning device establishes or detects an open circuit as the circuit is not carrying current and simultaneously determines the position of the sprinkler that has interrupted the circuit. Next, the scanning device releases the desired number of sprinklers nearby via the same electric wires that are used for said scanning. As a result, the number of electric wires can be significantly reduced. The voltage source can be a separate battery, the current of which heats the heating coils positioned around the heat-sensitive release bulb of the respective sprinklers.

The sprinklers and/or the spray heads of the installation can thus be arranged, e.g. in the case of the vehicle deck mentioned above, as an integral net without a definite division into sections; a section that is adapted to each fire position but that is considerably smaller than those of previous solutions is automatically activated, whereby on the one hand the waste of extinguishing liquid, especially during the usually critical initial stage of the fire fighting, can be significantly reduced and on the other hand the drive unit of the installation can be, to the corresponding degree, smaller dimensioned.

In the following, the invention will be described in detail with reference to the preferred exemplary embodiments illustrated in the enclosed drawing.

Figure 1:
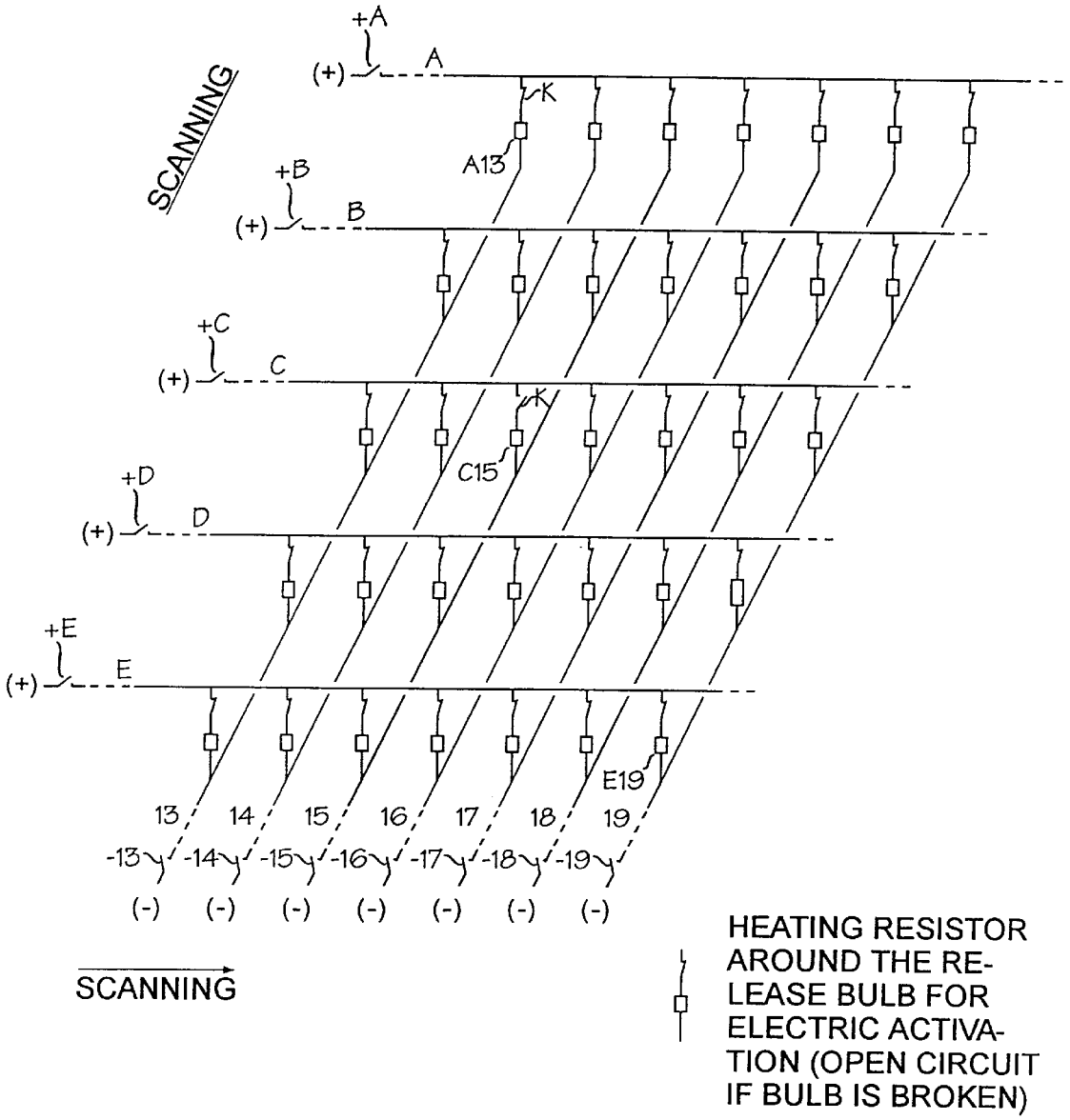
FIGS. 1–3 show schematically part of a larger installation at a first stage with a single sprinkler released as a result of a fire that has broken out, and sprinklers additionally released in a second and a third stage as planned.
Figure 2:
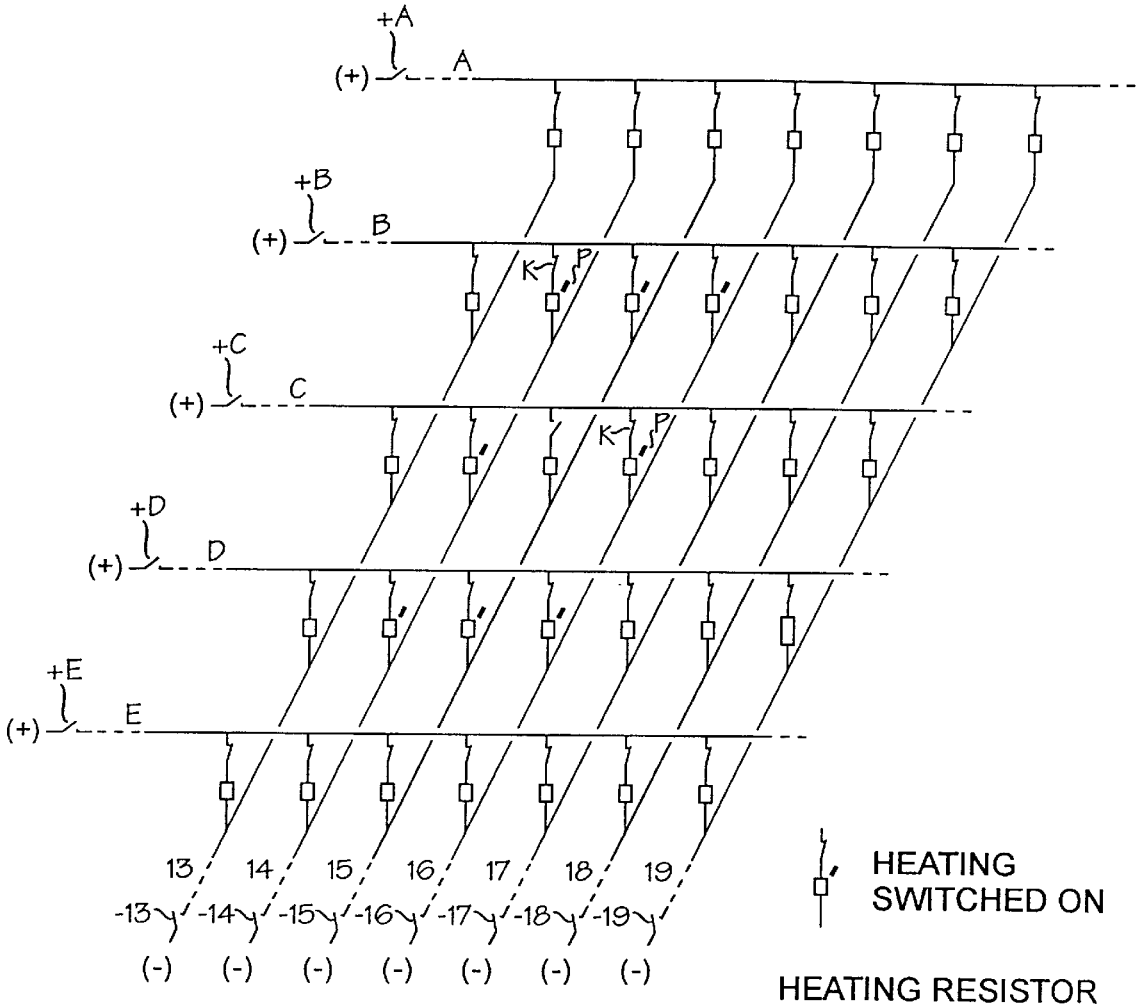
Figure 3:
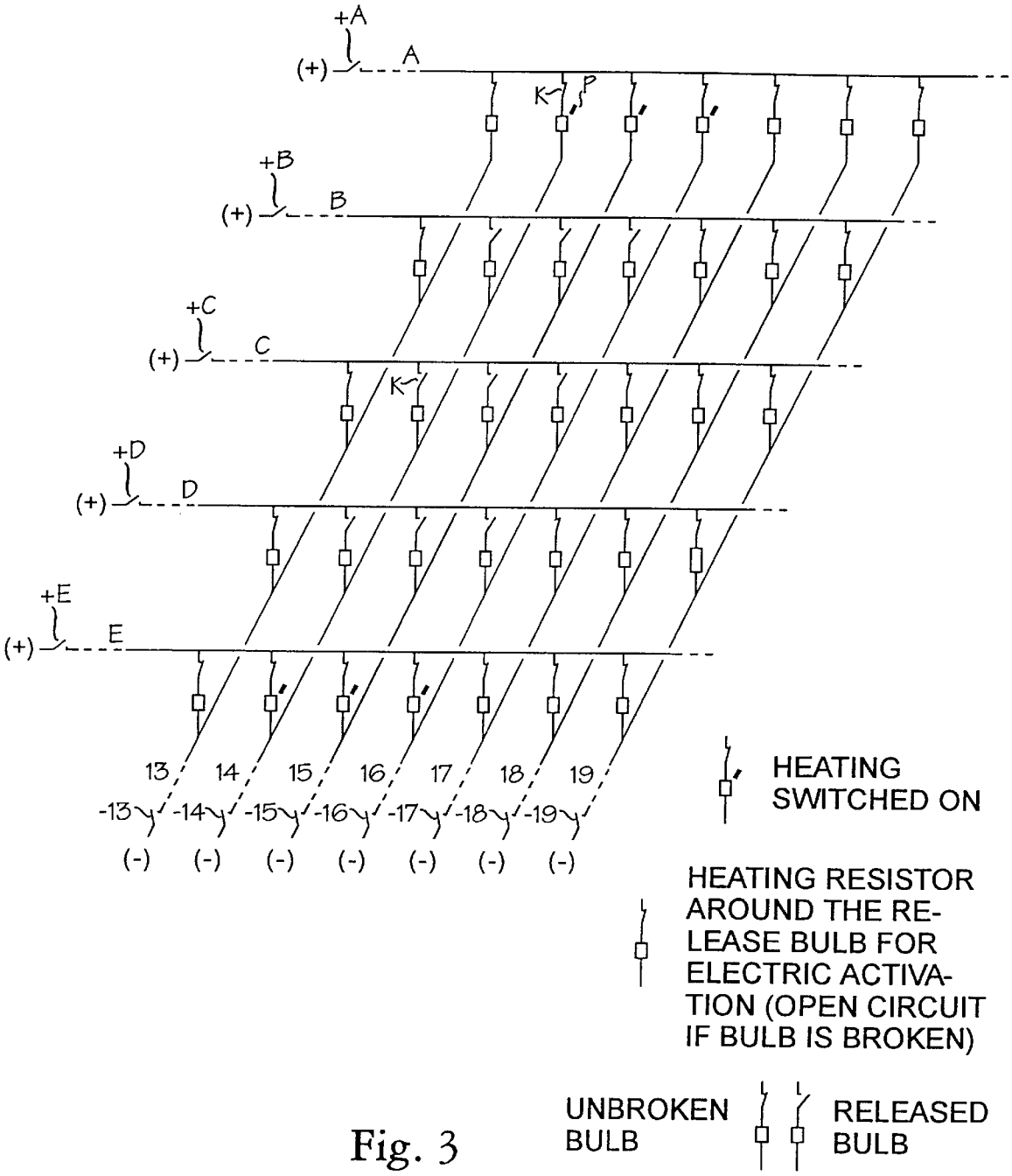

In FIGS. 1–3, the sprinklers of the installation are arranged in an electric net or a grid comprising a number of positive wires A–E and negative wires 13–19 running laterally to the positive wires, in each case between a positive wire and a negative wire so that the position of the respective sprinklers can be expressed by means of the positive and negative wires; A13 . . . C15 . . . E19.

As regards the respective wires, the connecting and disconnecting of a scanning device is indicated by means of breakers +A . . . +E and –13 . . . –19. A breaker K indicates the state of the respective sprinklers; the closed breaker K, which, e.g. in the case the sprinklers A13 and E19 in FIG. 1, indicates an inactive or unbroken state, which can also be called a standby state, and an open breaker K, which, e.g. in the case of the sprinkler C15 in FIG. 1, indicates a released or an activated state. An arrow P for a sprinkler with a closed breaker K indicates an initiated active electric release of the sprinkler, i.e. the sprinklers B14 . . . B16, C14 and C16, D14 . . . D16 in FIG. 2, A14 . . . A16, and E14 . . . E16 in FIG. 3.

The sprinklers can be individually scanned by connecting the positive wires A–E in proper order and connecting the negative wires 13–19 separately for each positive wire in proper order. Available devices are thus capable of scanning, e.g. an installation for such a car ferry that was mentioned earlier, in about a second.

In FIG. 1, all the breakers +A . . . +E and –13 . . . –19 are open, as is the breaker K of the sprinkler C15, which indicates that a fire has released the sprinkler C15 after the scanning last passed the sprinkler C15, the scanning being in progress outside FIG. 1. The next time the scanning reaches the positive wire C, and the breaker +C is closed, and along the positive wire C reaches the negative wire 15, and the breaker –15 is closed, it is established that the scanning circuit +C . . . C15. . . –15 is open and that there is a fire at C15.

As shown in FIG. 2, the positive wires B and D and the negative wires 14 and 16 are then automatically also connected by means of the scanning device for an active electric release of the sprinklers B14 . . . B16, C14 and C16, and D14 . . . D16 that are located around the sprinkler C15. As shown in FIG. 3, when these sprinklers have been activated, a third step in which, for instance, the sprinklers A14 . . . A16, and E14 . . . E16 are actively released can be initiated.

Figure 4:
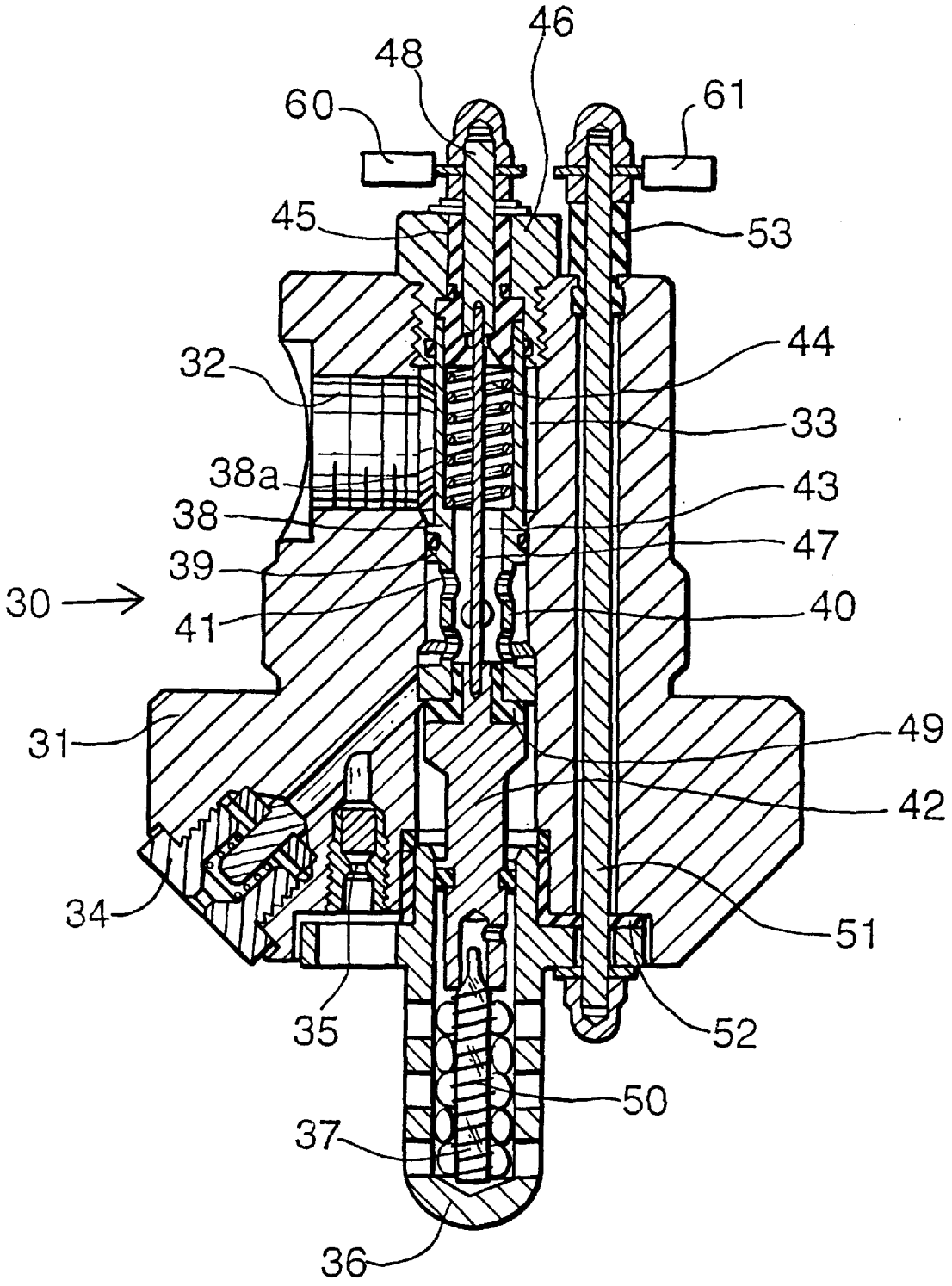
FIGS. 4 and 5 show a longitudinal section of a preferred embodiment of sprinklers that can be used in the installation and that are in the standby state and active or released state, respectively.
Figure 5:
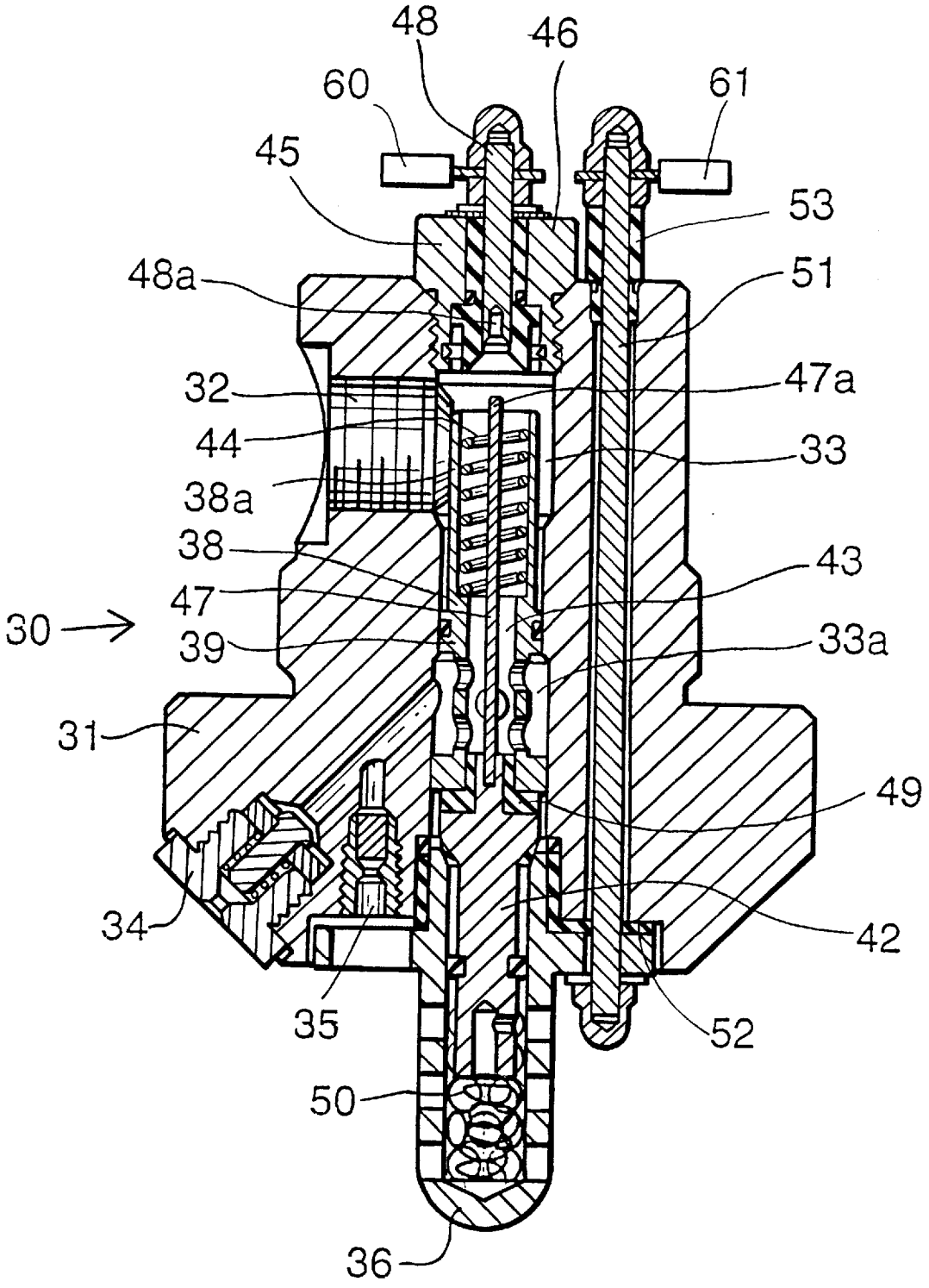

FIGS. 4 and 5 show a section of an embodiment of a sprinkler, which may well be used in the installation according to FIGS. 1–3 but which, naturally, also can be used independently in other applications. The sprinkler is generally marked with 30, its housing or frame with 31 and its liquid inlet with 32. The liquid inlet 32 leads to a central channel 33 which branches in a number of, e.g. nine, oblique nozzles 34, of which every third may have a jointly fed additional nozzle 35 in the usually downwards directed bottom of the sprinkler. A holder 36 for a conventional heat-sensitive release bulb 37, e.g. a glass vial that explodes at an elevated temperature, is also mounted to the bottom of the sprinkler.

In the central channel 33 of the sprinkler, a spindle 38 is arranged to slide, which spindle at the top at liquid inlet 32 has a sleeve 38*a,* which is followed by a piston-like part 39 sealed against the sprinkler housing 31, the part being called piston hereinbelow, which part is followed by a narrower distribution part 40 provided with orifices 41, which distribution part 40 finally ends in an end part 42 insulatingly sealed against the vial holder 36.

An axial channel 43 runs through the sleeve 38*a,* the piston 39 and the distribution part 40 and, in the part thereof that runs in the sleeve 38*a,* a helical spring 44 is fixed with its lower end according to the Figures resting on the piston 39 and with its upper end at least in standby state according to FIG. 4 resting on an insulating piece 45 fixed in a head 46 screwed into the housing 31. An electricity conducting rod 47 runs though the channel 43, the upper end of the rod 47 in FIG. 4 being in an electricity conducting but disengagable contact with a conducting element 48 which is connected to a positive pole 60. The lower end of the rod 47 is in a corresponding contact with the end part 42 of the spindle, which in addition to being insulated from the vial holder 36 also is insulated from the spindle parts 38–40 that are in contact with the housing 31 by means of an insulating casing 49, and from direct contact with the housing 31 by an air gap. A heating coil 50 is placed around the release bulb 37, which coil is in conducting contact with the end part of the spindle and the vial holder 36, which is electrically connected by means of a conducting element 51 running through the housing 31 to a negative pole 61. The holder 36 and the element 51 are insulated from the housing 31 by means of insulating casings 52 and 53 and from the part of the element that runs through the housing by means of an air space.

The force of the spring 44 and the ring area of the piston 39, which is under the influence of the fluid pressure in the inlet 32, are adjusted in such a way that the spindle 38 in the standby state of the sprinkler according to FIG. 4 does not crush the vial 37 when the vial has a normal temperature. The spindle 38 is thus arranged to at least partially balance the fluid pressure of the inlet 32. If the sleeve 38*a* slides against the wall of the channel 33 so that contact is established, a complete balance of the fluid pressure in the inlet 32 is achieved; only the spring 44 presses the spindle. The upper end of the sleeve 38*a* lies snugly between the insulating piece 45 and the head 46; there is no connection for the liquid from the inlet 32 to the spindle channel 43 and further to the nozzles 34 and 35; however, an electricity conducting connection does exist from the positive pole 60 through the element 48, the rod 47, the end part 42 of the spindle, the heating coil 50, the vial holder 36 and the element 51 to the negative pole; corresponds to the closed breaker K, FIGS. 1–3. The scanning is so rapid that the heating coil 50 is not heated.

If the vial 37 as a result of hot gases or active heating by means of sufficient current through the heating coil 50, explodes, the force of the spring 44 knocks down the spindle 38 as a block against the vial holder 36, as illustrated in FIG. 5. In the event that a small imbalance of the fluid pressure prevails at the inlet at the nozzle, the force knocking down the spindle is constituted of said spring force added with the small additional downward force which the partial imbalance in the fluid pressure exerts on the spindle. The spindle sleeve 38*a* moves sufficiently far in order to provide a connection for the liquid from the inlet 32 to the channel 43 and further to the nozzles 34 and 35, preferably with high pressure and penetrating concentration in accordance with the patent application PCT/FI92/00155. Furthermore, the end 47*a* of the rod 47 comes off from its insertion 48*a,* the other end of the rod comes possibly off from its corresponding insertion in the end part 42. This corresponds to an open breaker K, FIGS. 1–3.

I claim:

1. An installation for fire fighting, comprising a number of circuits with sprinklers, each circuit being arranged to automatically be separately switched on in the event of a fire after release of a sprinkler in the circuit at the site of the fire, a number of electric positive and negative wires, which have been arranged to a scanning device comprising breakers (+A–+E, –13, ––19) for each positive and negative wire, wherein said wires form an electric net where positive and negative wires are electrically connected via sprinklers respectively comprising individual breakers (K), each sprinkler being arranged to open its breaker (K) upon the release of the sprinkler in question and to thus interrupt the connection between the respective positive and negative wire, and wherein the scanning device, upon establishing the interrupted connection and the position of the released sprinkler, is arranged to release according to a plan sprinklers adjacent to said position by closing according to said plan the breakers (+A–+E, –13, ––19) of the scanning device.

2. An installation according to claim 1, comprising sprinklers with a heat-sensitive release bulb (37), wherein the scanning device is arranged to release the desired number of adjacent sprinklers via the same electric wires that are used for the scanning, by conducting an electric current through a heating coil (50) placed around the heat-sensitive release bulb (37) of the respective sprinklers in order to heat the release bulb.

* * * * *

UNITED STATES PATENT AND TRADEMARK OFFICE

CERTIFICATE OF CORRRECTION

PATENT NO. : 5,871,055
DATED : February 16, 1999
INVENTOR(S) : Goran Sundholm

It is certified that error appears in the above-identified patent and that said Letters Patent is hereby corrected as shown below:

TITLE PAGE, ADD THE FOLLOWING:

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | Name |
|---|---|---|---|---|---|---|---|---|---|---|---|---|---|
| | | 4 | 2 | 3 | 3 | 1 | 7 | | 05/1982 | Sweden | | | Claussen |
| | | 2 | 5 | 3 | 3 | 3 | 5 | 4 | 01/1977 | W. Germany | | | Thilo et al. |
| | | 2 | 5 | 4 | 8 | 8 | 5 | 0 | 06/1976 | W. Germany | | | Purt |
| | | 9 | 3 | 2 | 1 | 9 | 9 | 8 | 11/1993 | WIPO | | | Sundholm |
| | | 4 | 2 | 2 | 5 | 9 | 9 | 7 | 02/1994 | W. Germany | | | Schroeder |
| | | 9 | 2 | 2 | 0 | 4 | 5 | 3 | 11/1992 | WIPO | | | Sundholm |
| | | 5 | 2 | 2 | 2 | 5 | 8 | | 01/1993 | EPO | | | Schaefers et al. |
| | | | | | | | | | | | | | |

Signed and Sealed this

Twenty-sixth Day of October, 1999

*Attest:*

Q. TODD DICKINSON

*Attesting Officer*

*Acting Commissioner of Patents and Trademarks*